US006672021B2

(12) United States Patent
Kusano et al.

(10) Patent No.: US 6,672,021 B2
(45) Date of Patent: Jan. 6, 2004

(54) SWINGING DOOR STRUCTURE AND INNER FRAME IN WHICH INNER FRAME IS REMOVABLE

(75) Inventors: Mitsugi Kusano, Tokyo (JP); Kimio Numaguchi, Tokyo (JP); Norio Hidaka, Tokyo (JP); Yasuhiro Takagi, Tokyo (JP); Tetsuji Nagaoka, Tokyo (JP); Nobuyuki Miyanaga, Tokyo (JP)

(73) Assignees: Foris Corporation, Tokyo (JP); Kaider Base Board Industry Company Limited, Tokyo (JP)

( * ) Notice: Subject to any disclaimer, the term of this patent is extended or adjusted under 35 U.S.C. 154(b) by 12 days.

(21) Appl. No.: 09/900,909

(22) Filed: Jul. 9, 2001

(65) Prior Publication Data

US 2002/0020124 A1 Feb. 21, 2002

(30) Foreign Application Priority Data

Jul. 21, 2000 (JP) ..... 2000-221362

(51) Int. Cl.[7] ..... E06B 1/04

(52) U.S. Cl. ..... 52/211; 52/204.5; 52/213; 52/656.4; 49/380; 49/504

(58) Field of Search ..... 52/211, 213, 217, 52/656.4, 656.5, 656.7, 656.1, 656.9, 204.51, 204.591, 204.5; 49/380, 382, 504, 397, 399

(56) References Cited

U.S. PATENT DOCUMENTS

| | | | | | |
|---|---|---|---|---|---|
| 3,774,345 | A | * | 11/1973 | Cole et al. | 49/504 |
| 4,034,514 | A | * | 7/1977 | Cecil | 49/504 |
| 4,223,494 | A | * | 9/1980 | Wendt | 52/211 |
| 4,281,480 | A | * | 8/1981 | Wendt | 49/504 |
| 4,376,354 | A | * | 3/1983 | Passovoy | 49/504 |
| 4,430,830 | A | * | 2/1984 | Sailor | 52/211 |
| 4,505,080 | A | * | 3/1985 | Sailor | 52/211 |
| 4,531,337 | A | * | 7/1985 | Holdiman | 52/217 |
| 5,058,323 | A | * | 10/1991 | Gerritsen | 49/504 |
| 5,216,839 | A | * | 6/1993 | Woodruff | 49/382 |
| 5,293,723 | A | * | 3/1994 | Slessor | 52/213 |
| 5,371,987 | A | * | 12/1994 | Hirsch | 52/207 |
| 5,423,149 | A | * | 6/1995 | Herbst | 49/382 |
| 5,584,157 | A | * | 12/1996 | Sun | 52/656.4 |
| 5,758,458 | A | * | 6/1998 | Ridge | 52/204.1 |
| 5,836,118 | A | * | 11/1998 | Thornton et al. | 52/204.1 |
| 6,125,605 | A | * | 10/2000 | Young | 52/717.01 |
| 6,520,288 | B1 | * | 2/2003 | Quam et al. | 181/287 |

FOREIGN PATENT DOCUMENTS

| | | |
|---|---|---|
| JP | 4-216793 | 8/1992 |
| JP | 11-336426 | 12/1999 |

* cited by examiner

*Primary Examiner*—Carl D. Friedman
*Assistant Examiner*—Yvonne M. Horton
(74) *Attorney, Agent, or Firm*—Jordan and Hamburg LLP

(57) ABSTRACT

A door assembly allows one to easily and freely change a hinged side and an opening direction of a door when or after a resident moves into a house. Detachable inner frames having doorstop portions, flat portions, and locking nails are mounted to locking grooves in left and right vertical outer frames around spacers and a door main body is mounted to a heelpost side flat portion through hinges. By dividing a doorframe into the vertical outer frames and the inner frames, in order to change a hinged side of the door, the inner frames are pulled out from the vertical outer frames and inserted into the locking grooves in the vertical outer frames after changing orientation of the inner frames according to the hinged side or exchanging the inner frames for the inner frames suitable for the hinged side and the opening direction to thereby easily change the hinged side of the door main body.

20 Claims, 11 Drawing Sheets

SWINGING DOOR STRUCTURE AND INNER FRAME IN WHICH INNER FRAME IS REMOVABLE

BACKGROUND

The present invention relates to an inner frame for a single door or a set of double doors for an apartment, for example, and a door structure for which the inner frame is used.

Conventionally, a hinged door such as a single door and a set of double doors is used as a door for an apartment, for example. The most general single door varies not only in size but also in which side of the door is hinged (hereafter referred to as "a hinged side") and which direction the door opens in (hereafter referred to as "an opening direction"). There are doors of various combinations of hinged sides and opening directions depending on layouts of the respective apartments.

Selection of the hinged side and the opening direction of the door is made by an architect of the building in view of a life traffic line and use of respective rooms of a resident, i.e., arrangement of pieces of furniture. However, unlike a custom house, in the case of a condominium or an apartment for rent, the architect has no choice but to design the doors with the residents in mind. In the present age in which there are various life styles, an actual resident may desire to change the hinged side and the opening direction of the door according to his/her preference in use of the door when he/she moves into an apartment or a house. A resident may desire to change the hinged side and the opening direction of the door because he/she bought a new piece of furniture or in order to re-do rooms by rearranging pieces of furniture after he/she moves into a custom house or a condominium.

However, change of the hinged side and the opening direction of the door, which seems to be a simple operation, cannot be easily achieved in reality because of various problems. For example, in order to change a hinged side of an inward open and left hinged door without changing the inward opening, displacement of the hinges is necessary and at least a new latch hole for locking needs to be provided in a doorframe. A latch hole and holes for screws for fixing the hinges in the doorframe and which have been used are concealed in some way but this is clearly not preferable in view of design. Therefore, replacement of the doorframe is considered. However, the doorframe is normally fixed to a partition wall of the apartment or house and cannot be detached easily and a part of the partition wall has to be torn down in many cases. In an apartment, because of a relationship between the thickness of a partition wall used and the thickness of a main body, a doorstop portion of a doorframe is generally formed at a distance in a direction from a center of the doorframe. Therefore, turning the door over in order to change inward opening into outward opening does not work. In such a case, replacement of the doorframe is an absolutely necessary condition after all and change of the opening direction is difficult.

Therefore, it is an object of the present invention to provide a hinged door inner frame by which a hinged side and an opening direction of a door can be changed by a resident in some cases without necessity of special skills when or after the resident moves into an apartment or a house after completion of construction and a door structure for which the door inner frame is used.

It is another object of the present invention to provide a door structure by which, as the door frame can be easily divided into the outer frame and the inner frame according to the invention, it is possible to freely change the hinged side and the opening direction of the door without working on the outer frame itself.

Furthermore, another object of the present invention is to provide a door structure by which construction marks are not left after the change and it is unnecessary to change the outer frame at all. Even a resident can easily change the hinged side and the opening direction of the door without necessity of special skills.

BRIEF SUMMARY OF THE INVENTION

The present invention provides a hinged door inner frame wherein an inner frame can be mounted to and detached from an outer frame and is formed by integrally molding a doorstop portion and a flat portion extending from the doorstop portion.

A feature of of the present invention is that the inner frame further comprises at opposite end portions thereof locking nails which can be mounted to and detached from locking grooves formed in the outer frame.

Another feature of the present invention is that the hinged door structure comprises outer frames, inner frames which can be mounted to and detached from the outer frames, and a door main body supported for swinging by one of the inner frames. Each the inner frame includes a doorstop portion, a flat portion extending from the doorstop portion, and locking nails which are at opposite end portions of the inner frame and which can be mounted to and detached from locking grooves formed in each outer frame.

With the above structure, the inner frames can be mounted to and detached from the outer frames. Therefore, in order to change the opening direction (inward open/outward open) of a single door without changing the hinged side (left hinged/right hinged), for example, exchanging the right and left inner frames, turning the door main body over, and mounting the door main body are all that is needed.

Therefore, in order to change the hinged side of the door when or after the resident moves into the apartment or the house, major modification to the wall and the like, including the outer frames is unnecessary.

If mounting orientations of the inner frames are changed or if the inner frames are exchanged, mounting holes of screws and the like and marks of latch holes for locking the door handle which are formed in the outer frames are covered to maintain beauty. In mounting or exchanging the inner frames, positioning of the inner frames in mounting is easy. As compared with the case in which the inner frames are mounted only by screws and the like, deformation of the inner frames due to force acting in opening and closing of the door is suppressed and airtightness and smoothness of operation of the door are ensured.

Still another feature of the present invention is that a spacer is disposed between each of the outer frames and each of the inner frames.

By disposing the spacer as described above, gaps between opposite end faces of the door main body and flat portions of the inner frames can be adjusted, the inner frames are mounted firmly, and airtightness and smoothness of the operation of the door are ensured.

Yet another feature the present invention is that the door main body has a door handle in a position at a height which is half the height of a vertical inner frame on one side of the door main body in a door width direction and has hinges for supporting the door main body for swinging on an end face of the other side of the door main body, and at least part of the hinges are mounted in positions at the same distance from upper and lower opposite ends of the vertical inner frame. This structure is used when the door main body is not very high and the door handle may be mounted in the position at the height which is half of the height of the vertical inner frames without being too high from a floor to use. The number of positions to which the hinges are mounted is not limited to two but may be three or more.

With this structure, when the left and right inner frames are turned upside down through 180°, vertical positions of the door handle and the hinge portions in door main body and the latch receiver for locking in the inner frame are not changed. Therefore, in order to change the hinged side of the door only, turning the left and right vertical inner frames upside down through 180° in a front view of the door, turning orientations of hinge shaft receiving portions of the door side hinges through 180°, and mounting the hinge shaft receiving portions are all that is necessary. In order to change the opening direction of the door only, turning the left and right vertical inner frames from side to side through 180° in a top view of the door and mounting the vertical inner frames are all that is necessary. Furthermore, it is possible to cope with a difference in the hinged side of the door by preparing one type of door main body and left and right inner frames.

A still further feature of the present invention is that the door main body has a door handle in a position at a predetermined height on one side of the door main body in a door width direction and has hinges for supporting the door main body for swinging on an end face of the other side of the door main body. By this character, mounting positions of the hinges can be set arbitrarily.

Therefore, regardless of the opening direction of the door, in order to change the hinged side, the inner frames are replaced by inner frames corresponding to the hinged side and the opening direction. In order to change the opening direction of the door only, turning the left and right vertical inner frames from side to side through 180° in the top view of the door and mounting the vertical inner frames are all that is needed.

DETAILED DESCRIPTION OF THE INVENTION

Figure 1:
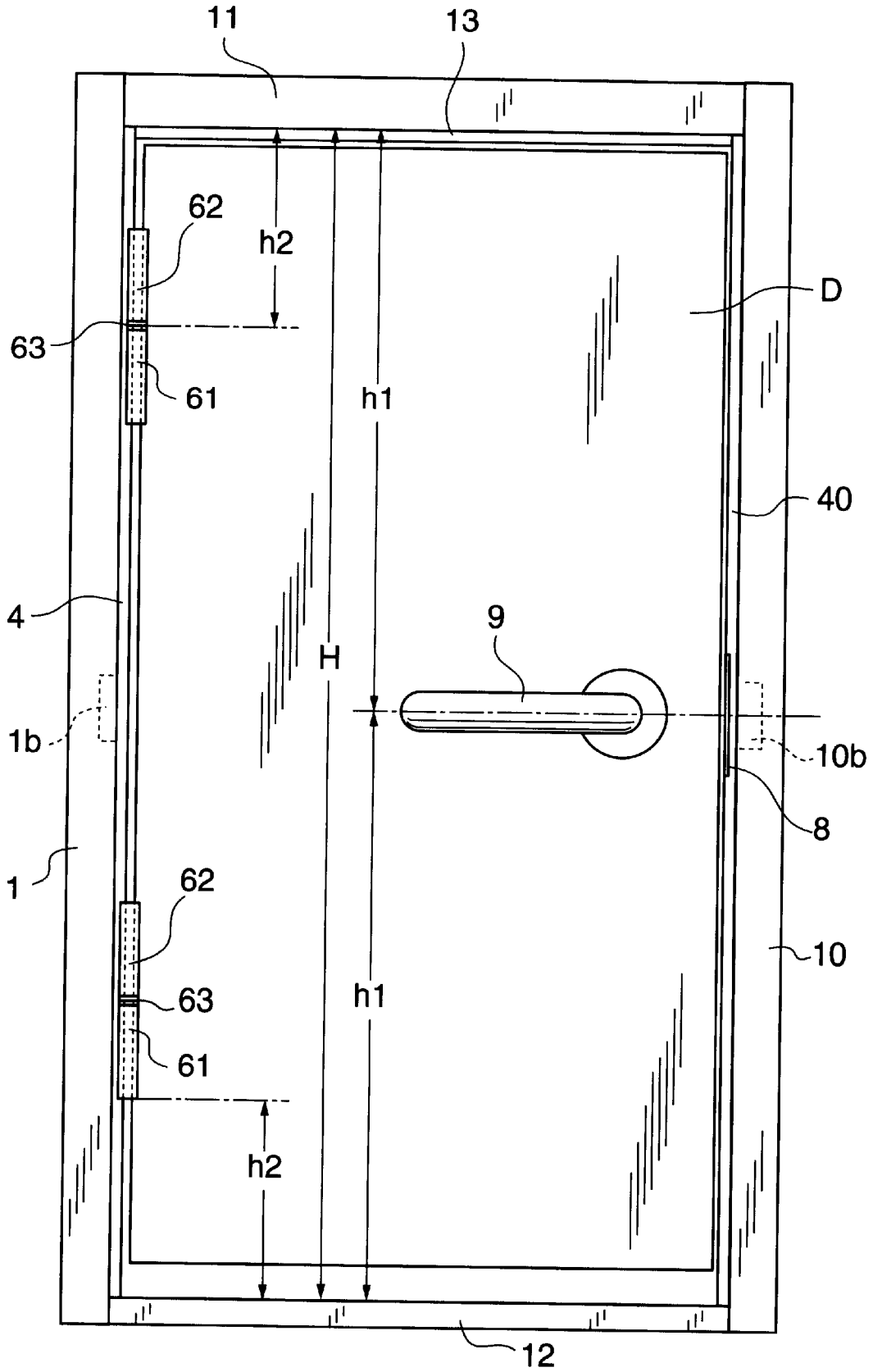
FIG. 1 is a front view of an entire door structure in which a mounting position of hardware is not specified.
Figure 2:
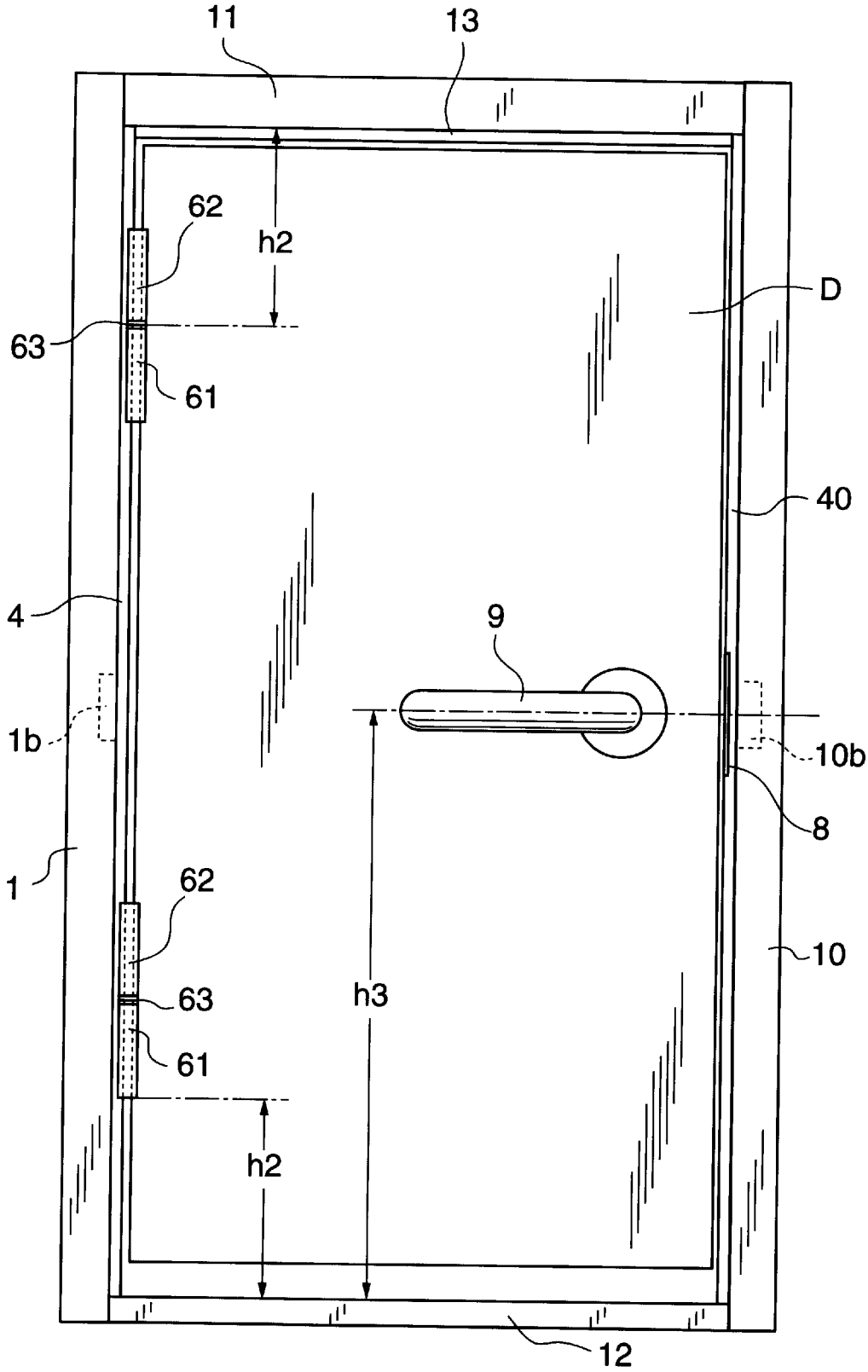
FIG. 2 is a front view of an entire door structure in which a mounting position of hardware is specified.

Embodiments of the present invention will be described below by reference to the drawings. FIGS. 1 and 2 are front views of a door structure. FIG. 1 shows the embodiment in which a mounting position of a door handle is not specified and FIG. 2 shows the embodiment in which a mounting position of the door handle is specified. In FIGS. 1 and 2, an outer frame body formed of an upper outer frame 11, a threshold 12, and left and right vertical outer frames 1 and 10 is formed in a wall face. An upper inner frame, a heelpost side inner frame 4 according to the invention of the present application, and a door end side inner frame 40 are incorporated in an inner end face of the outer frame body. Frame side hinges 61 are mounted to the inner frame 4 and door side hinges 62 are respectively mounted to upper and lower portions of an end face of the door on a heelpost side (left side in the drawings). Therefore, a single door main body D mounted to a door opening portion can be opened and closed. A door handle (knob) 9 is provided on a door end side (right side in the drawings) of the door main body D.

Figure 3:
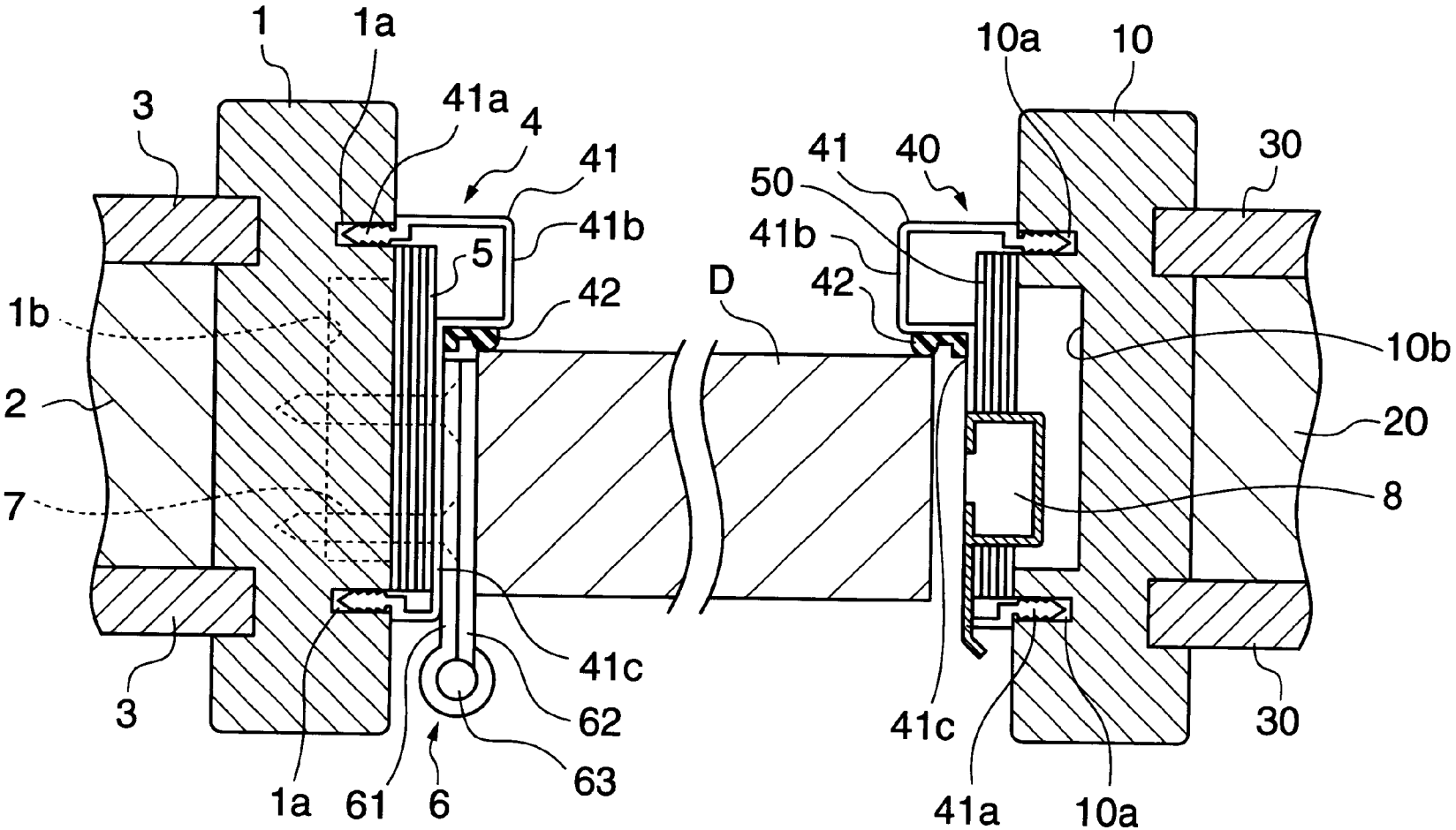
FIG. 3 is an enlarged sectional view of an essential portion of a first embodiment of the present invention.

When an order is received, if the mounting position of the door handle 9 is specified to be at a height which is half of height H of the vertical inner frames 4 and 40 or if the mounting position of the door handle 9 is not specified. The door handle 9 may be mounted at the height which is half of the height H of the vertical inner frames 4 and 40 without being too high to use. The door handle is mounted at the height h1 which is half of the height H of the vertical inner frames 4 and 40 and the upper and lower hinges 61 are mounted to positions h2 at the same distance from the upper and lower opposite ends of the vertical inner frame as shown in FIG. 1. In this case, an upper end of the upper hinge 61 is set in a position at a distance h2 from the upper outer frame 11 and a lower end of the lower hinge 61 is set in a position at a distance h2 from the threshold 12. If the mounting position of the door handle 9 is specified to be at a position which is not half of the height H of the vertical inner frames 4 and 40, or if the door handle 9, mounted to the position which is half of the height H, is hard to use, the door handle 9 is set at a height h3 which is not half of the height H of the vertical inner frames 4 and 40 and the hinges 61 are set in positions at the distance h2 similarly to the above as shown in FIG. 2. In FIG. 3, left structures and right structures of the vertical outer frames 1 and 10, wood shafts 2 and 20, boards 3 and 30, and the door end side inner frame 40 and the heelpost side inner frame 4 are substantially the same as each other. Components of the inner frames 4 and 40 are provided with the same reference numerals.

The first embodiment of the invention will be described. In FIG. 3, pairs of locking grooves 1*a*, 1*a* and 10*a*, 10*a* are respectively formed throughout lengths of inner end faces of the left and right vertical outer frames 1 and 10 positioned to face each other such that the grooves of each the pair are parallel. Furthermore, holes 1*b* and 10*b* in which a latch receiver 8 is to be provided are formed in central portions of the end faces of the vertical outer frames 1 and 10 inside the locking grooves, i.e., at the same level as the door handle 9. The wood shafts (furring) 2 and 20 are secured to the outer end faces of the vertical outer frames 1 and 10 and the boards 3, 3, 30, 30 for forming walls are provided on opposite sides of the wood shafts with tip end portions of the boards being inserted in the vertical outer frames to thereby form the walls.

Figure 4:
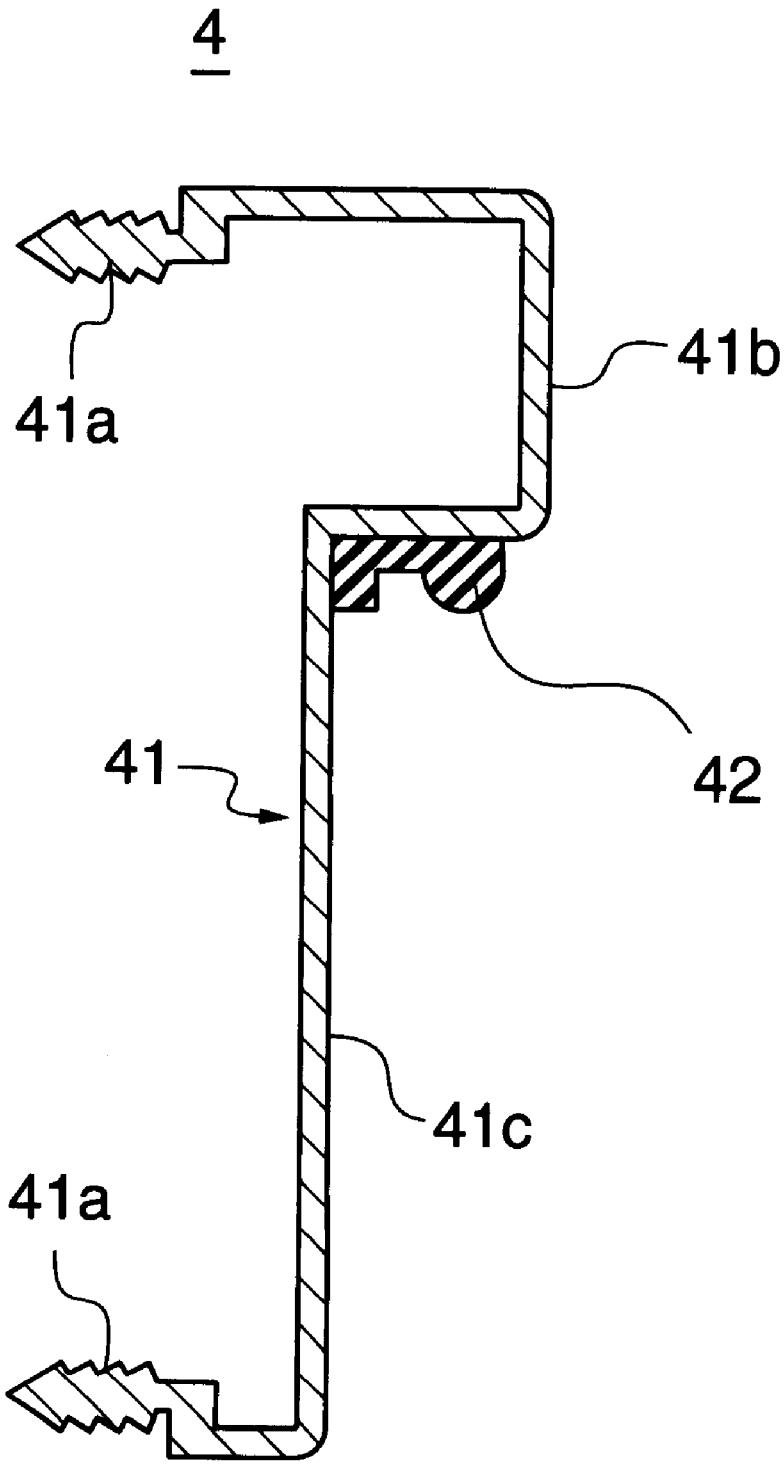
FIG. 4 is an enlarged sectional view of an inner frame.

An enlarged sectional view of the inner frame 4 is shown in FIG. 4. The inner frame 4 is integrally molded of two resins, i.e., an ABS resin and a styrene elastomer. Specifically, A main body portion 41 which is one of components of the inner frame is formed by extruding the ABS resin and locking nails 41*a*, 41*a* are integrally formed with opposite end portions of the main body portion in the same direction as each other. The locking nails 41*a*, 41*a* have serrated sectional shapes such that the locking nails can be easily inserted into the locking grooves 1*a*, 1*a* (see FIG. 3) of the vertical outer frame 1 and are hard to detach from the grooves.

Figure 5:
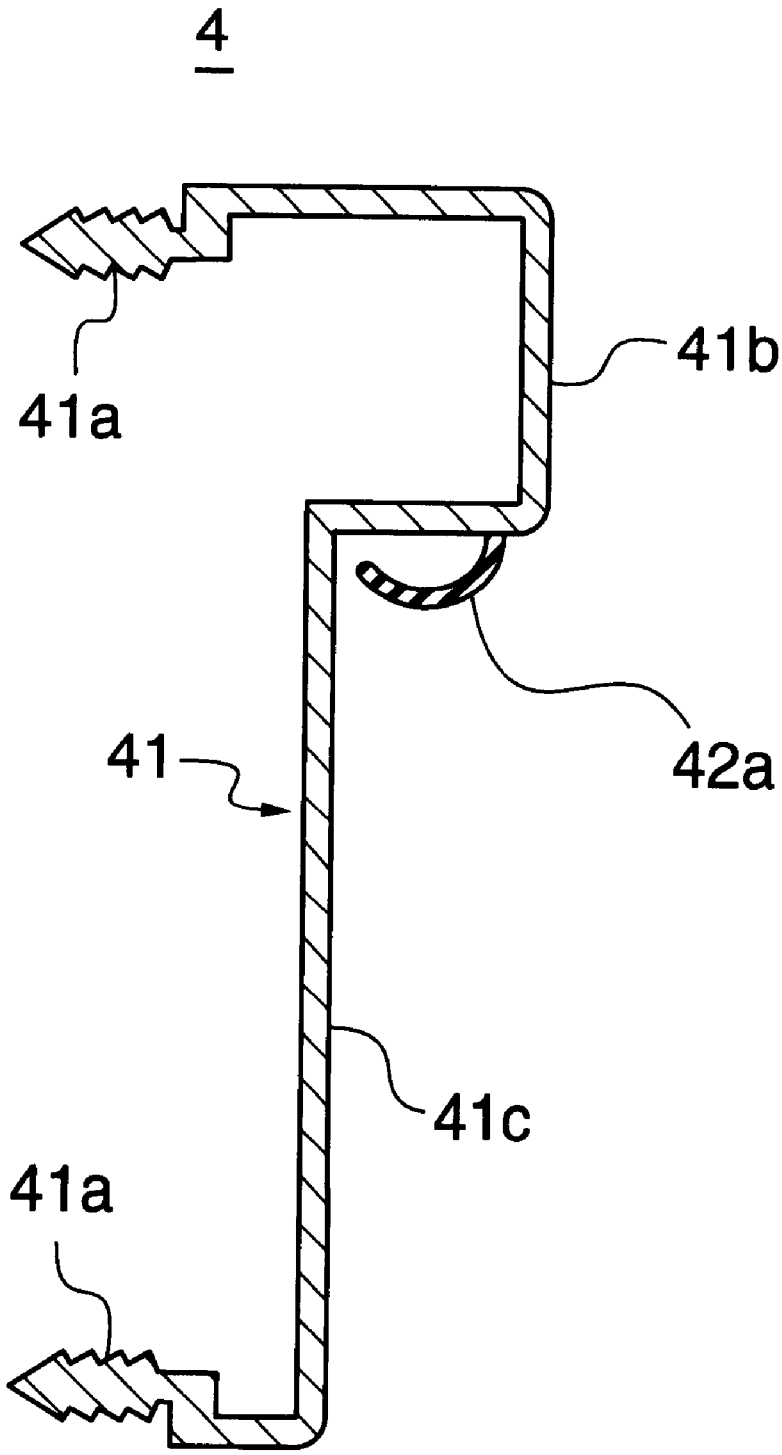
FIG. 5 is an enlarged sectional view of another embodiment of the inner frame shown in FIG. 4.

Components of the main body portion 41 are an angular U-shaped doorstop portion 41*b* on one side (an upper side in FIG. 3) and a flat portion 41*c* extending from the doorstop portion toward the other side (a lower side in FIG. 3). Furthermore, a cushioning portion 42 is formed in a position rising from the flat portion 41*c* to the doorstop portion 41*b*. Because the cushioning portion is made of styrene elastomer material, the cushioning portion has elastic force. In order to further increase the elastic force of the cushioning portion, the cushioning portion 42 may be bent in a hollow arcuate shape like a cushioning portion 42*a* shown in FIG. 5. A width of the flat portion 41*c* is larger than a thickness of the door main body D.

As shown in FIG. 3, by disposing spacers 5, 50 formed of a plurality of veneers and capable of adjusting their thicknesses between the inner frames 4, 40 and the vertical outer frames 1, 10, mounting of the inner frames is reinforced and airtightness of the door main body D is improved. Hinges 6 each formed of a frame side hinge 61, a door side hinge 62, and a hinge shaft 63 are provided to the heelpost side (left side in FIG. 3). The frame side hinge is secured to the flat portion 41*c* of the inner frame 4 by screws 7 screwed down into the vertical outer frame 1 through the inner frame 4 and the spacer 5. The door side hinge 62 is secured to the inner end face of the door main body D by a screw. The latch receiver 8 for locking is secured by a screw to the central portion of the door end side (right side in FIG. 3) inner frame 40 in a state in which the latch receiver 8 is inserted into the hole 10*b*. The spacers 5, 50 may have lengths to fully cover the heights of the inner frames 4 and 40 or may be divided to respectively have lengths to cover portions of the inner frames screwed to the vertical outer frames 1, 10, and portions to which the frame side hinges 61 and the latch receiver 8 are mounted.

A constructing procedure of the door structure in the embodiment of the invention will be described. In FIGS. 1 and 3, the vertical outer frames 1, 10 and the upper outer frame 11 are first fixed to the wood shafts 2, 20 and the threshold 12 is fixed to a floor regardless of the hinged side and the opening direction of the door. After the hinged side is checked, the locking nails 41*a* of the respective inner frames 4, 40 are inserted into the locking grooves 1*a*, 10*a* in the vertical outer frames 1, 10 around the spacers 5, 50. Then, the frame side hinges 61 are fixed to the upper and lower portions of the heelpost side inner frame 4 by screws passing through the inner frame 4 and the spacer 5. The latch receiver 8 is fixed to the door end side inner frame 40 by the screw passing through the inner frame 40 and the spacer 50. The door side hinges 62 are mounted to the door main body D and the door main body is hung on the vertical outer frames 1, 10 through the hinge shafts 63.

Figure 6:
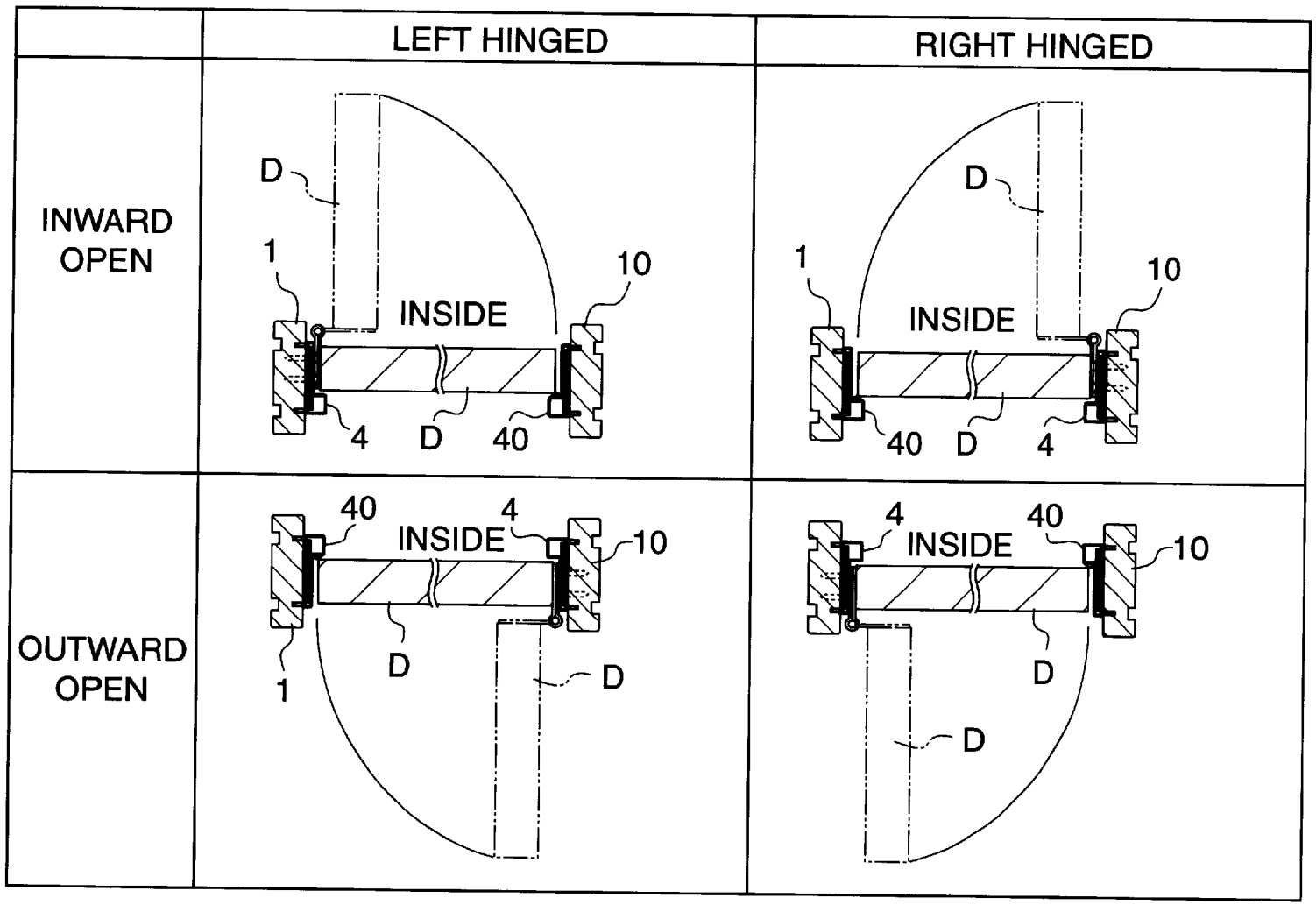
FIG. 6 is a sectional view for explaining a hinged side and an opening direction of the door.

Next, operations of changing the hinged side and the opening direction of the door will be described by reference to FIGS. 1, 3, and 6. In the case shown in FIG. 1, the door main body D has the door handle 9 on one side in a door width direction and at the height h1 which is half of the height of the vertical inner frames 4, 40. The hinges 6 (61, 62) for supporting the door main body for swinging are mounted such that the upper end of the upper hinge 61 is in the position at the distance h2 from the upper outer frame 11 and that the lower end of the lower hinge 61 is in the position at the distance h2 from the threshold 12. An operation procedure for changing the hinged side and, at the same time, the opening direction from "right hinged/outward open" to "left hinged/inward open", for example will be described. First, (1) the door main body D is lifted and detached from the hinge shafts 63. Then, (2) the upper inner frame 13 is detached from the upper outer frame 11, the inner frame 4 is detached from the heelpost side vertical outer frame 1 together with the frame side hinges 61, and the inner frame 40 is detached from the door end side vertical outer frame 10 together with the latch receiver 8. Then, (3) the heelpost side and door end side vertical inner frames 4, 40 are turned upside down and (4) the locking nails 41*a*, 41*a* are inserted into the locking grooves 1*a* and 10*a* of the corresponding vertical outer frames 1 and 10. Then, (5) the frame side hinges 61 are mounted to the heelpost side inner frame 4 and the latch receiver 8 is mounted to the door end side inner frame 40. (6) The upper inner frame 13 is turned from side to side through 180° and mounted to the upper outer frame 11. (7) The door side hinges 62 of the door main body D are detached, (8) orientations of hinge bearings are reversed, (9) the door side hinges 62 are mounted to the door main body D, and (10) the vertical outer frames 1, 10 are mounted finally.

Next, the case in which only the hinged side of the door is changed and in which "right hinged/outward open" is changed into "left hinged/outward open", for example will be described. Similarly to the above (1) and (2), the door main body D and the inner frames (three sides) 4, 40, and 13 are detached, (3) the heelpost side and door end side vertical inner frames 4 and 40 are turned upside down, (4) the vertical inner frames 4 and 40 are exchanged such that the vertical inner frame 4 which was mounted to the vertical outer frame 1 is placed on the vertical outer frame 10 side and that the vertical inner frame 40 which was mounted to the vertical outer frame 10 is placed on the vertical outer frame 1 side. Then the locking nails 41*a*, 41*a* are inserted into the locking grooves 1*a*, 10*a* of the vertical outer frames 1, 10. Then, (5) the frame side hinges 61 are mounted to the heelpost side inner frame 4, the latch receiver 8 is mounted to the door end side inner frame 40, and (6) the upper inner frame 13 is mounted to the upper outer frame 11 in an original state. Then, procedures similar to the above operation procedures (7) to (10) are carried out.

In the case of changing "right hinged/outward open" into "right hinged/inward open", this change can be achieved by the operation procedure as described above except that the inner frames 4, 40 are not turned upside down, the vertical inner frames 4 and 40 are exchanged such that the vertical inner frame 4 which was mounted to the vertical outer frame 1 is placed on the vertical outer frame 10 side and that the vertical inner frame 40 which was mounted to the vertical outer frame 10 is placed on the vertical outer frame 1 side, and the upper inner frame 13 is turned from side to side through 180°.

This method for changing "right hinged/outward open" into "right hinged/inward open" can be also carried out by the similar procedure in the case as shown in FIG. 2 in which the door handle 9 is set at the predetermined height h3.

However, if "right hinged/outward open" is changed into "left hinged/inward open" or if "right hinged/outward open" is changed into "left hinged/outward open", the vertical inner frames 4 and 40 are turned upside down and therefore the position of the latch receiver 8 is displaced from a proper position in the example of FIG. 2. Therefore, it is preferable to prepare a spare vertical inner frame in advance.

When the door main body D becomes unnecessary, if cover bodies C which will be described later are prepared in advance, mounting the cover bodies C to the outer frames 1, 10, and 11 after detaching the door main body D and the inner frames 4, 40, 13 is all that is needed. If an opening frame between a kitchen and a living room and without a door is a frame formed of the outer frames 1, 10, 11 and the cover bodies C, it is possible to newly provide a door by a simple operation by only exchanging the cover bodies C for the inner frames 4, 40, 13.

Figure 7:
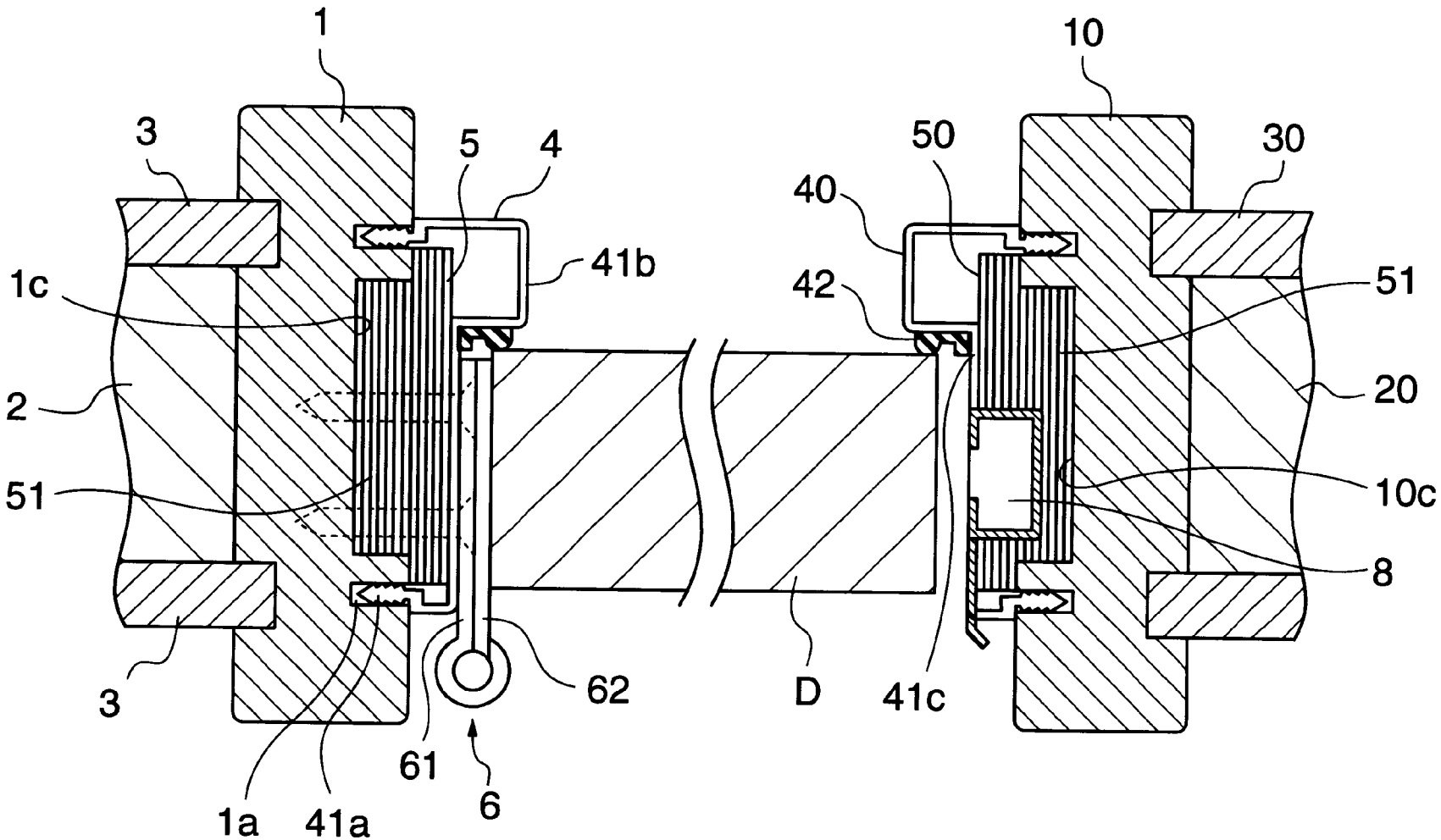
FIG. 7 is an enlarged sectional view of an essential portion of a second embodiment of the invention.

Next, a second embodiment of the invention will be described by reference to FIG. 7. This embodiment is characterized in that the vertical outer frames 1, 10 are formed with groove portions 1*c*, 10*c* in sizes corresponding to shapes of the holes 1*b*, 10*b* (see FIG. 3) into which the latch receiver 8 in the first embodiment of the invention is to be inserted and that spacer blocks 51, 51 formed by laminating a plurality of veneer pieces are inserted at predetermined intervals in the grooves. The blocks 51 and the spacers 5 and 50 are formed with gaps in positions where the latch receiver 8 is to be inserted. By forming as described above, it is unnecessary to form the holes (1*b*, 10*b* in FIG. 3) in which the latch receiver 8 is to be inserted in the vertical outer frame 1 or 10 and the spacer 5 or 50 at a worksite. The other structures are substantially the same as those shown in FIG. 2.

Figure 8:
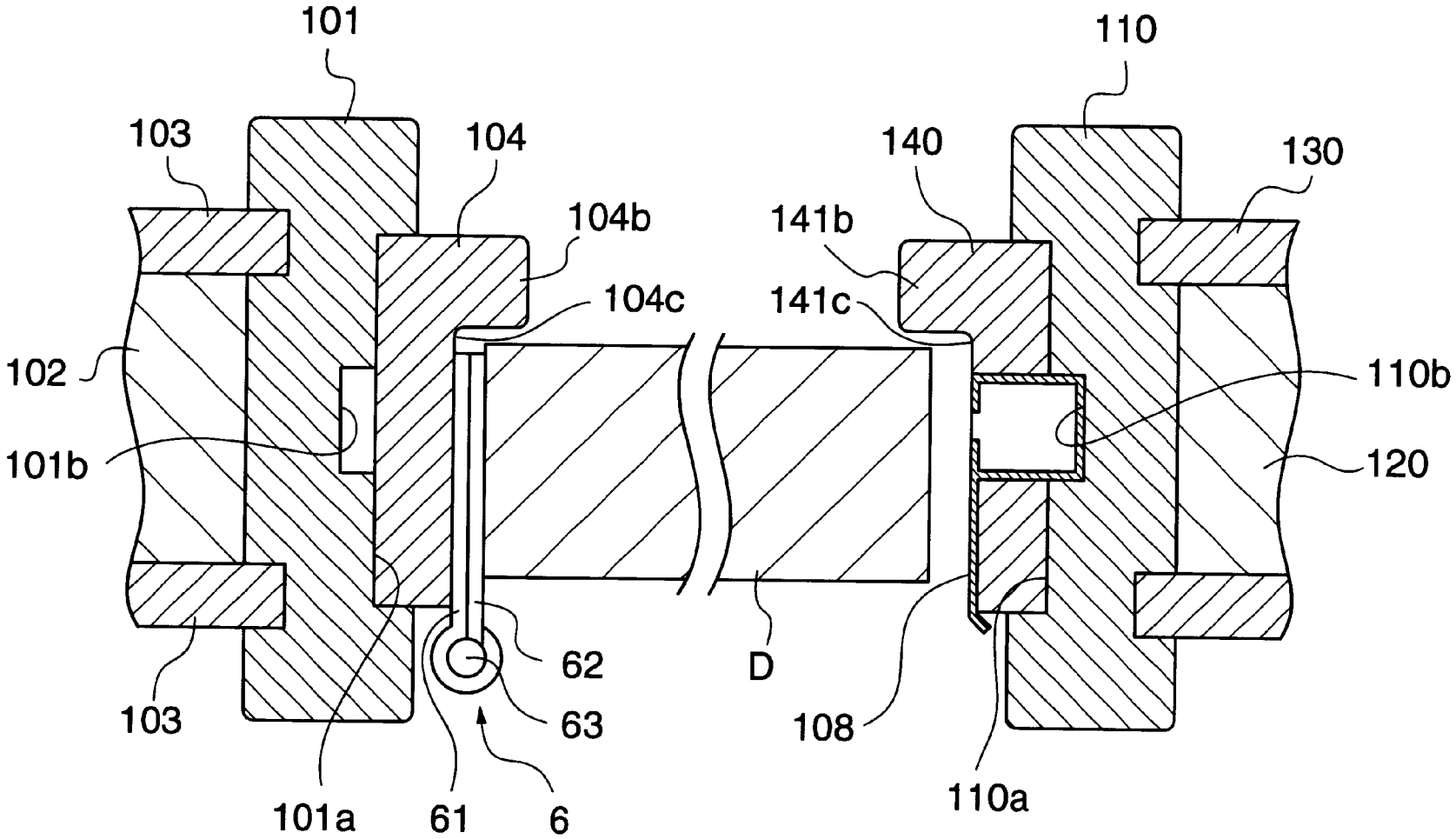
FIG. 8 is an enlarged sectional view of an essential portion of a third embodiment of the invention.

A third embodiment of the invention will be described by reference to FIG. 8. Woody inner frames 104, 140 are fitted in fitting holes 101*a*, 110*a* formed in inner side faces of opposite outer frames 101, 110, the inner frames are substantially in L shapes, and components of the inner frames are doorstop portions 104*b*, 141*b* bent in one directions and flat portions 104*c*, 141*c* extending from the doorstop portions. Holes 101*b*, 110*b*, for the latch receiver are formed in the inner end faces of the opposite vertical outer frames 101, 110 and the latch receiver 108 is mounted to the door end side inner frame 140 in a position corresponding to the latch hole 110*b*. Reference numerals provided to the members in the embodiment shown in FIG. 8 are obtained by adding 100 to the reference numerals provided to the respective members in the embodiment shown in FIG. 2 and the respective reference numerals correspond to each other.

Figure 9:
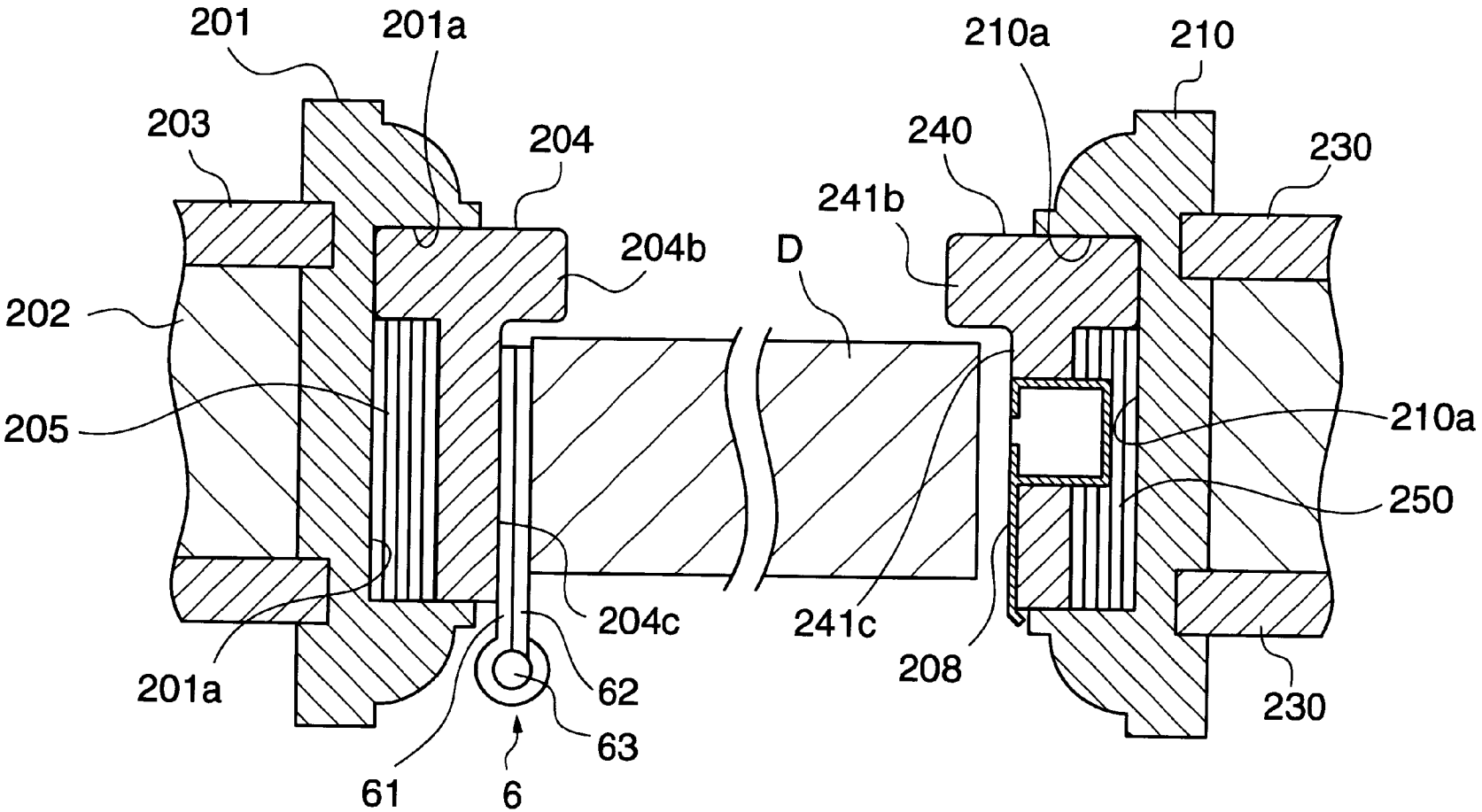
FIG. 9 is an enlarged sectional view of an essential portion of a fourth embodiment of the invention.

A fourth embodiment of the invention will be described by reference to FIG. 9. Woody inner frames 204, 240 are respectively fitted in fitting holes 201*a*, 210*a* in such positions as to face each other in inner end faces of opposite outer frames 201, 210, the inner frames are substantially in T shapes as a whole, and components of the inner frames are doorstop portions 204*b*, 241*b* and flat portions 204*c*, 241*c* extending from the doorstop portions. In gaps (the fitting holes 201*a*, 210*a*) between the inner frames 204, 240 and the outer frames 201, 210, a plurality of spacer blocks 205, 250 formed by laminating a plurality of veneers are disposed at predetermined intervals. In this state, the inner frames are screwed to the outer frames. Reference numerals provided to the members shown in FIG. 9 are obtained by adding 200 to the reference numerals provided to the members shown in FIG. 2 and the respective reference numerals correspond to each other. The same reference numerals are provided to the door main body D and the hinges 6.

Figure 10:
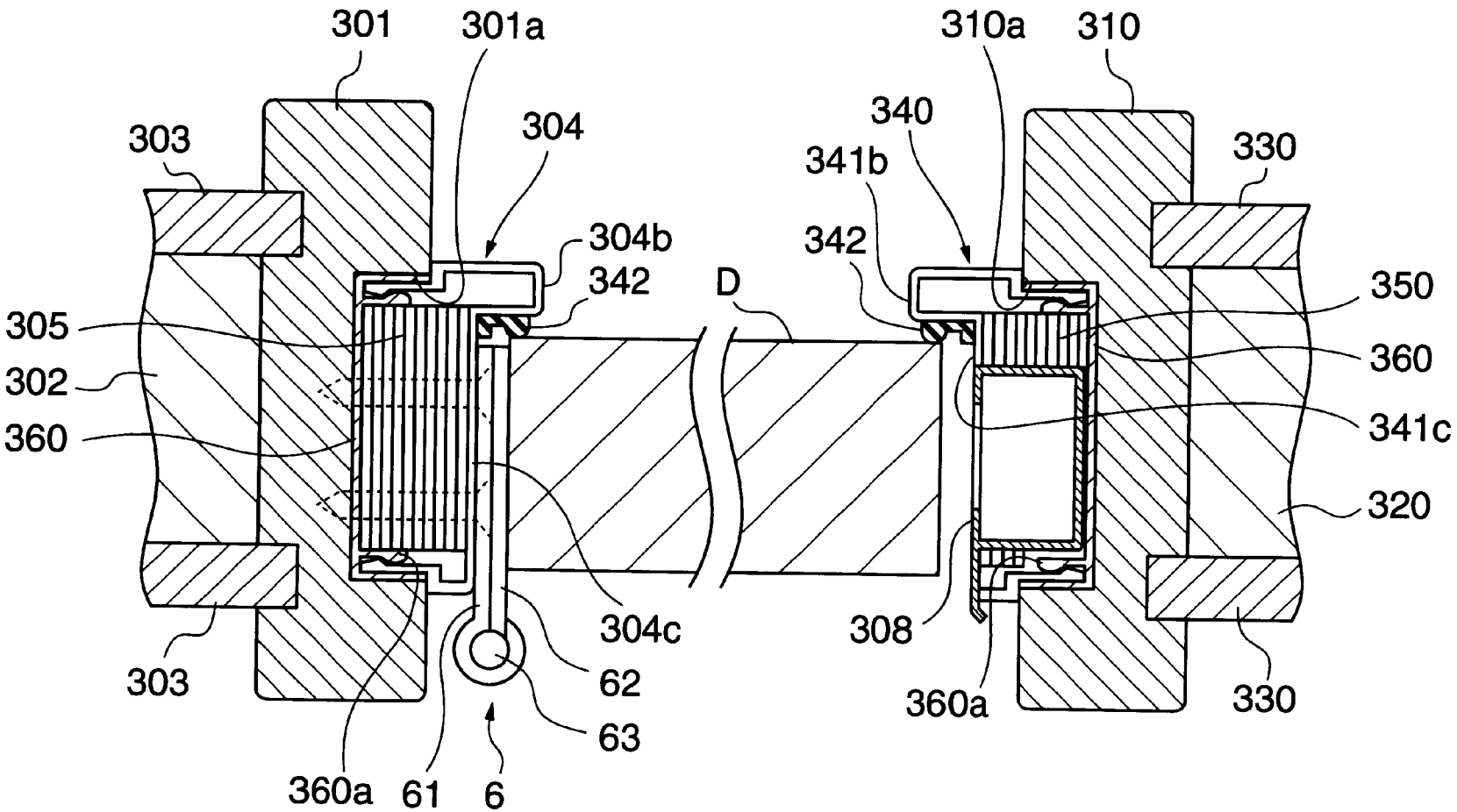
FIG. 10 is an enlarged sectional view of an essential portion of a fifth embodiment of the invention.

A fifth embodiment of the invention will be described by reference to FIG. 10. Locked plates 360 are provided in fitting holes 301*a*, 310*a* formed in such positions as to face each other in inner end faces of opposite outer frames 301, 310 and opposite end portions of the locked plates are formed into locking nails 360*a*, 360*a*. To the locking nails, locking nails on opposite ends of inner frames 304, 340 are locked. The inner frames 304, 340 are integrally molded of two resins, i.e., a rigid ABS resin and a styrene elastomer and are formed with doorstop portions 304*b*, 341*b*, flat portions 304*c*, 341*c*, and cushioning portions 342 like the example shown in FIG. 3. In gaps between the inner frames 304, 340 and the locked plates 360, spacer blocks 305, 350 formed by laminating a plurality of veneers are disposed. Reference numerals provided to the members shown in FIG. 10 are obtained by adding 300 to the reference numerals provided in FIG. 2. The same reference numerals are provided to the door main body D and the hinges 6.

Although the single door structure has been described in the above embodiments of the invention, the invention can be also applied to a structure of a set of double doors to change a hinged side of an outward open structure and an inward open structure.

Figure 11:
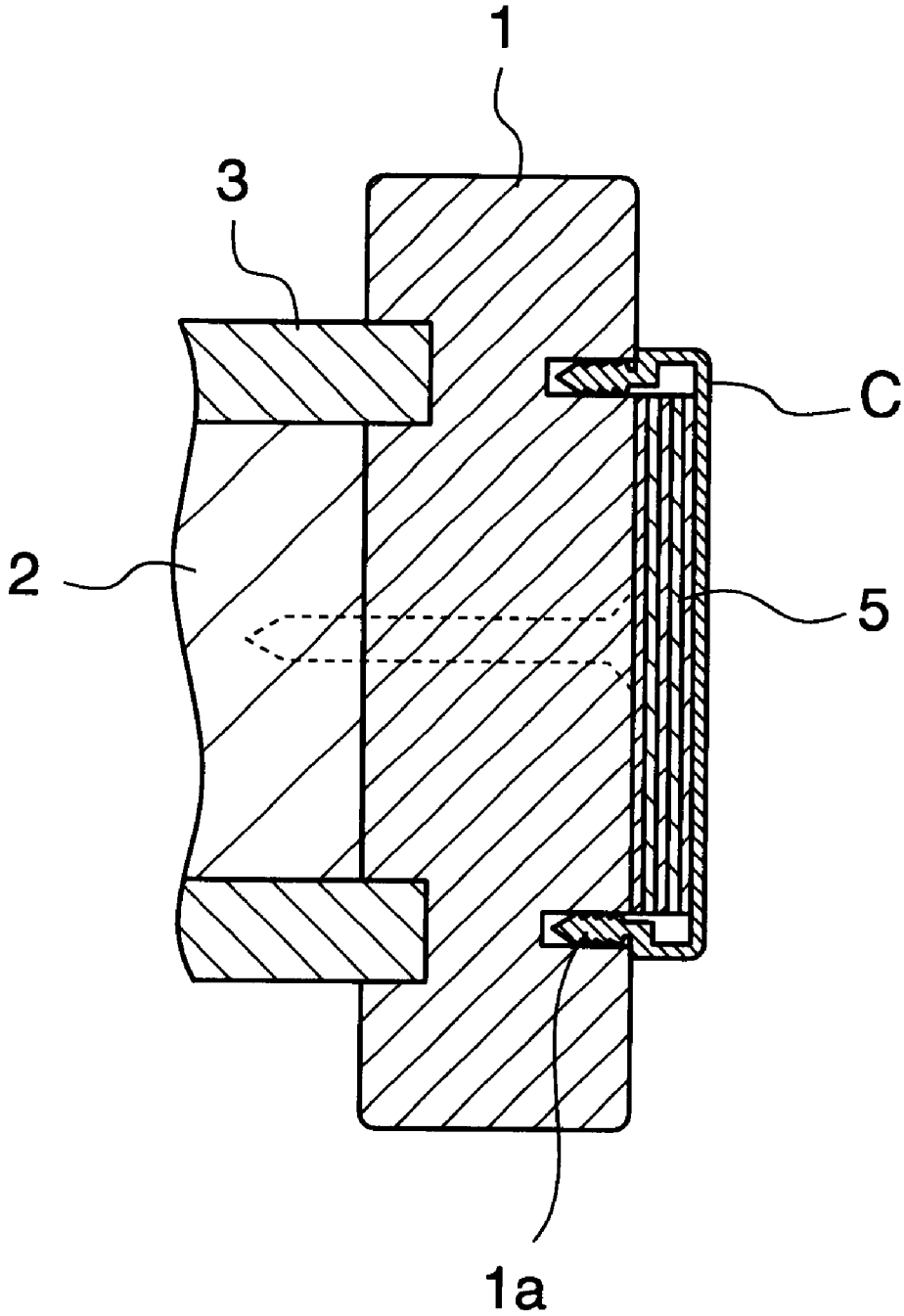
FIG. 11 is an enlarged sectional view showing a state in which a cover body is mounted to an outer frame when a main door body is not used.

As described above, it is possible to freely and easily change the hinged side of the door by the invention. Furthermore, it is convenient that the door does not exist in some cases when a layout of the apartment is changed. For example, in the embodiment shown in FIG. 3, when the door is removed, the inner frames 4, 40, the spacers 5, 50, and other hinges 6 and door main body D are detached from the vertical outer frames 1, 10 and a door space is used as a passage. In such a case, as shown in FIG. 11, the cover body C is mounted by inserting locking nails formed at opposite ends of the cover body C into the locking grooves 1*a* in the vertical outer frame 1 through the spacer 5. As a result, he locking grooves 1*a* formed in the vertical outer frame 1 are covered and can not be visually recognized from outside, which is preferable in view of beauty.

What we claim as our invention is:

1. A hinged door frame kit for forming a door frame structure installable in a wall opening, comprising:

a door;

an outer frame body including right and left vertical outer frame members respectively having right and left inside faces which when installed in the wall opening have said left and right inside faces perpendicular to a plane of the wall opening and opposing one another;

an inner frame;

said inner frame including a heelpost side inner frame member configured to hingeably accept said door, said heelpost side inner frame member being installable to both said right and left inside faces;

said inner frame including a door end side inner frame member installable to both said right and left inside faces;

a pair of locking grooves formed in parallel over a full length in a longitudinal direction of the left and right inside faces;

said heelpost side inner frame member and said door end side inner frame member being integrally formed of a door stop portion thereof and a flat portion thereof that extends from said door stop portion;

locking nails formed along opposing sides said heelpost side and door end side inner frame member;

said locking nails being detachably insertable into said locking grooves such that:

said heelpost side inner frame member is installable in both said left and right vertical outer frame members when said left and right vertical outer frame members are already installed in said wall opening; and said door end side inner frame member is installable in both said left and right vertical outer frame members when said left and right vertical outer frame members are already installed in said wall opening;

thereby said heelpost side inner frame member and said door end side inner frame member are interchangeable between installation in said left and right vertical outer frame members when said left and right vertical outer frame members are already installed in said wall opening; and spacers disposed between said left and right outer vertical frame members and both said heelpost side and door end side inner frames.

2. The kit according to claim 1, wherein:

said door has opposing first and second side portions with corresponding first and second edge faces; and said door is provided with a door handle on said first side portion at an installed position at half a height of said inner frame; and said door is provided on said second edge face with a plurality of hinges for swingably supporting said door, with at least a part of said hinges positioned so as to correspond to a same distance from both an upper and a lower end of said vertical inner frame.

3. The kit according to claim 1, wherein:

said door has opposing first and second side portions with corresponding first and second edge faces; and said door is provided with a door handle on said first side portion at a predetermined height; and said door is provided on said second edge face with a plurality of hinges for swingably supporting said door.

4. The kit according to one of claims 2 and 3 wherein ones of said spacers are disposed to sUpport said plurality of hinges against a respective one of said left and right vertical outer frame members.

5. The kit according to claim 1 wherein hinges are provided to hingeably support said door and ones of said spacers are disposed .to support said hinges against a respective one of said left and right vertical outer frame members.

6. The kit according to claim 5 wherein: said door end side inner frame member has a latch receiver; and both said left and right outer vertical frame members include a latch receiver recess for accepting said latch receiver.

7. The kit according to claim 6 wherein one of said spacers is disposed to support said latch receiver.

8. The kit according to claim 1 wherein:

said door end side inner frame member has a latch receiver; and both said left and right outer vertical frame members include a latch receiver recess for accepting said latch receiver.

9. The kit according to claim 8 wherein one of said spacers is disposed to support said latch receiver.

10. A hinged door frame kit for forming a door frame structure installable in a wall opening, comprising:

a door;

an outer frame body including right and left vertical outer frame members respectively having right and left inside faces which when installed in the wall opening have said left and right inside faces perpendicular to a plans of the wall opening and opposing one another;

an inner frame including:

a heelpost side inner frame member configured to hingeably accept said door; and a door end side inner frame member said heelpost side inner frame member and said door end side inner frame member having a door stop portion and a flat portion that extends from said door stop portion;

said heelpost side inner frame member being installable in both said left and right vertical outer frame members when said loft and tight vertical outer frame members are already installed in said wall opening; and said door end side inner frame member being installable in both said left and right vertical outer frame members when said left and right vertical cuter frame members are already installed in said wall opening;

thereby said heelpost side inner frame member and said door end side inner frame member are interchangeable between installation in said left and right vertical outer frame members when said left and right vertical outer frame members are already installed in said wall opening.

11. The kit according to claim 10, wherein:

said door has opposing first and second side portions with corresponding first and second edge faces;

said door is provided with a door handle on said first side portion at an installed position at half a height of said inner frame; and said door is provided on said second edge face with a plurality of hinges for swingably supporting said dear, with at least a part to said hinges positioned so as to correspond to a same distance from both an upper and a lower end of said inner frame.

12. The kit according to claim 10, wherein: said door has opposing first and second side portions with corresponding first and second edge faces; and said door is provided with a door handle on said first side portion at a predetermined height; and said door is provided on said second edge face with a plurality of hinges for swingably supporting said door.

13. The kit according to one of claims 11 arid 12 further comprising spacers disposed between said outer frame body and said inner frame to support said plurality of hinges against a respective one of said left and right vertical outer frame members.

14. The kit according to claim 10 wherein hinges are provided to hingeably support said door and spacers are disposed between said outer frame body and said inner frame to support said hinges against a respective one of said left and right vertical outer frame members.

15. The kit according to claim 14 wherein:

said door end side inner frame member has a latch receiver; and both said left and right outer vertical frame members include a latch receiver recess for accepting said latch receiver.

16. The kit according to claim 15 wherein a spacer is disposed between said outer frame body and said inner frame to support said latch receiver.

17. The kit according to claim 10 wherein:

said door end side inner frame member has a latch receiver; and both said left and right outer vertical frame members include a latch receiver recess for accepting said latch receiver.

18. The kit according to claim 17 wherein a spacer is dispose between said outer frame body and said inner frame to support said latch receiver.

19. The kit according to claim 10 flatter comprising detachable connectors for detachably connecting said heelpost side inner frame member and said door end side inner frame member to said left and right vertical oilier frame members.

20. The kit according to claim 19 wherein said detachable connectors include:

locking grooves formed in a longitudinal direction of the left and right inside faces:

locking nails formed along opposing sides said heelpost side and door end side inner frame member; and said locking nails being detachably insertable into said locking grooves.

* * * * *